US010799034B1

(12) United States Patent
Zietarsky et al.

(10) Patent No.: US 10,799,034 B1
(45) Date of Patent: Oct. 13, 2020

(54) COLLAPSIBLE MULTIPURPOSE APPARATUS

(71) Applicants: Darrell Raymond Zietarsky, Camrose (CA); Jason Sopka, Camrose (CA)

(72) Inventors: Darrell Raymond Zietarsky, Camrose (CA); Jason Sopka, Camrose (CA)

( * ) Notice: Subject to any disclaimer, the term of this patent is extended or adjusted under 35 U.S.C. 154(b) by 0 days.

(21) Appl. No.: 16/545,112

(22) Filed: Aug. 20, 2019

(51) Int. Cl.
*A47D 1/10* (2006.01)
*A47C 7/62* (2006.01)

(52) U.S. Cl.
CPC ..... *A47D 1/103* (2013.01); *A47C 7/624* (2018.08)

(58) Field of Classification Search
CPC ..... A47D 1/103; A47C 7/624; A47C 7/622; B60N 2/2833
USPC ..... 297/188.04, 254, 255, 256
See application file for complete search history.

(56) References Cited

U.S. PATENT DOCUMENTS 893,930 A * 7/1908 Lederman ..... A47K 3/122 4/579
2,349,092 A * 5/1944 Hammer ..... A47D 1/103 297/256
5,310,242 A * 5/1994 Golder ..... A47D 1/10 297/14
5,580,125 A * 12/1996 Alger ..... A47C 4/52 297/250.1

(Continued)

*Primary Examiner* — Milton Nelson, Jr.
(74) *Attorney, Agent, or Firm* — Capehart Law Firm

(57) ABSTRACT

A collapsible multiple purpose apparatus having a mounting framework defined by rear wall having a top edge, an opposing bottom edge, a first side edge and an opposing second side edge. The first and second side edges extend between the top edge and the bottom edge. The real wall has an inner surface and an outer surface. A first and second attachment member are located proximate the top edge and the first side edge and extend from the outer surface while being adapted to be secured over the back of a chair. A bottom support extends from the inner surface of the rear wall proximate the bottom edge and has a storage slot for receiving an item therein. A tray is pivotably securable to the bottom support for pivoting movement between a substantially perpendicular deployment relative to the inner surface of the mounting framework and a stored deployment adjacent to the inner surface. A first and second container stabilizer where each has a container stabilizer top edge, an opposing container stabilizer bottom edge, a container stabilizer first side edge and an opposing container stabilizer second side edge. The container stabilizer first and second side edges extend between the container stabilizer top edge and the container stabilizer bottom edge. The container stabilizer first side edge being pivotably securable to the first side edge of the rear wall for pivoting movement between a substantially side-by-side deployment relative to the first side edge of the rear wall and a stored deployment adjacent to the inner surface. A first and second container shelf being pivotably securable to the first and second container stabilizer bottom edge for pivoting movement between a substantially perpendicular deployment relative to the first and second container stabilizer and a stored deployment adjacent to the first and second container stabilizer. The first and second container shelves having a substantially circular container receiving opening.

5 Claims, 8 Drawing Sheets

(56) References Cited

U.S. PATENT DOCUMENTS

| | | | | |
|---|---|---|---|---|
| 2020/0054139 | A1* | 2/2020 | Morley, Jr. | A47C 3/34 |
| 2020/0205571 | A1* | 7/2020 | Tsai | A47C 7/624 |

* cited by examiner

COLLAPSIBLE MULTIPURPOSE APPARATUS

REFERENCE TO PENDING APPLICATIONS

This application does not claim the benefit of pending application.

BACKGROUND OF THE INVENTION

1. Field of the Invention

The present invention in generally directed to a holder for cups, cans, bottles, hand-held cell phones or the like, and, more particularly, relates to a foldable holder for supporting such items that is attached, removably or permanently, to the back of a seat.

2. Description of the Related Art

Holders for various items are in wide use. These holders allow a cup, can, bottle or the like to be secured so that a user may attend to other activities. Such holders are often made foldable or otherwise storable and redeployable (see U.S. Pat. Nos. D257,113S, D627,291S1, 2,767,895A, 5,072,909A, D336,218S, 2,932,544A, 4,466,659A, 9,907,372B2 and U.S. Pat. Pub. Nos. 2016/0107668A1 and 2011/0284416A1).

Such heretofore known and/or utilized foldable devices for holding beverage containers and other items are, however, often complex and bulky, require active mechanical components for initiating deployment, securement and/or restorage, and/or require unduly involved user intervention to initiate deployment, securement and/or restorage. Further improvement directed to such shortcomings would be useful.

Accordingly, there is a need for a device that addresses the needs set out above.

SUMMARY OF THE INVENTION

In some aspects, a collapsible multiple purpose apparatus is disclosed. The apparatus includes a mounting framework defined by rear wall having a top edge, an opposing bottom edge, a first side edge and an opposing second side edge, the first and second side edges extending between the top edge and the bottom edge. The rear wall has an inner surface and an outer surface. A first and second attachment members, such as attachment hooks, are located proximate the top edge and the first and second side edges and extending from the outer surface. The first and second attachment members are adapted to be secured over the back of a chair, such as stadium or theatre seat, etc.

In these aspects, a bottom support extends from the inner surface of the rear wall proximate the bottom edge. The bottom support has a storage slot for receiving an item, such as a mobile phone therein.

In these aspects, a tray is pivotably securable to the bottom support for pivoting movement between a substantially perpendicular deployment relative to the inner surface of the mounting framework and a stored deployment adjacent to the inner surface. The tray has a first and second opposite surfaces with the first surface for receiving an item thereon.

In these aspects, the apparatus includes a first and second container stabilizers. Each container stabilizer has a container stabilizer top edge, an opposing container stabilizer bottom edge, a container stabilizer first side edge and an opposing container stabilizer second side edge. The container stabilizer first and second side edges extending between the container stabilizer top edge and the container stabilizer bottom edge. The container stabilizer first side edge is pivotably securable to a side edge of the rear wall for pivoting movement between a substantially side-by-side deployment relative to the side edge of the rear wall and a stored deployment adjacent to the inner surface.

In these aspects, the apparatus includes first and second container shelves. Each of the container shelves are pivotably securable to a container stabilizer bottom edge for pivoting movement between a substantially perpendicular deployment relative to the container stabilizer and a stored deployment adjacent to the container stabilizer.

The container shelf has a substantially circular first container receiving opening for receiving a beverage cup, bottle or can. In some aspects, a mesh webbing is secured to the container receiving opening to aid in the retention of the received cup, bottle or can.

In some aspects, the attachment members are removably attachable to the outer surface of the rear wall. In these aspects, the outer surface of the rear wall includes a first and a second receiving notches located proximate to the top edge and the first and second side edges. The receiving notches are configured to removably receive an attachment member. The two attachment members have a securing end that is configured to engage the receiving notches to be removably secured thereto.

In some aspects, the apparatus includes a support stand that is pivotably secured to the outer surface of the rear wall for pivoting movement between a substantially perpendicular deployment relative to the outer surface of the rear wall and a stored deployment adjacent to the outer surface.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention constructed and operative according to the teachings of the present invention.

The various embodiments of the present invention will hereinafter be described in conjunction with the appended drawings, wherein like designations denote like elements.

DETAILED DESCRIPTION

Figure 1:
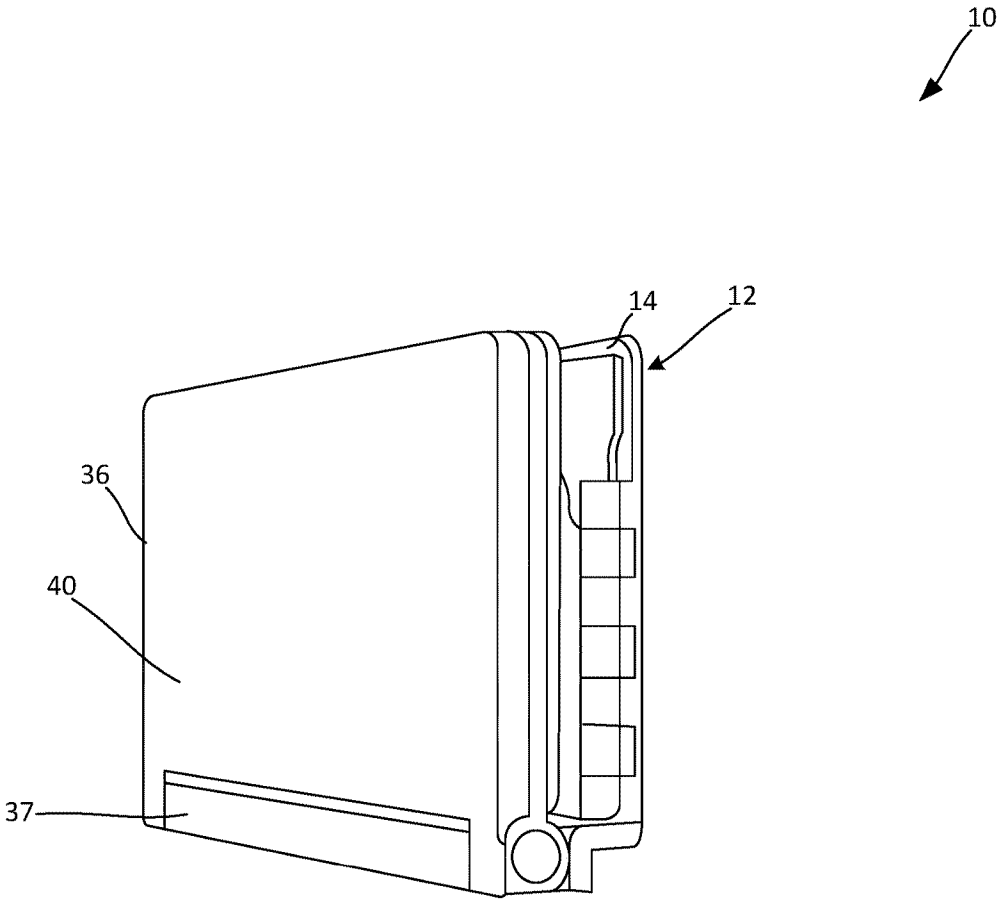
FIG. 1 is a perspective front view of an embodiment of the present invention in a closed position.
Figure 2:
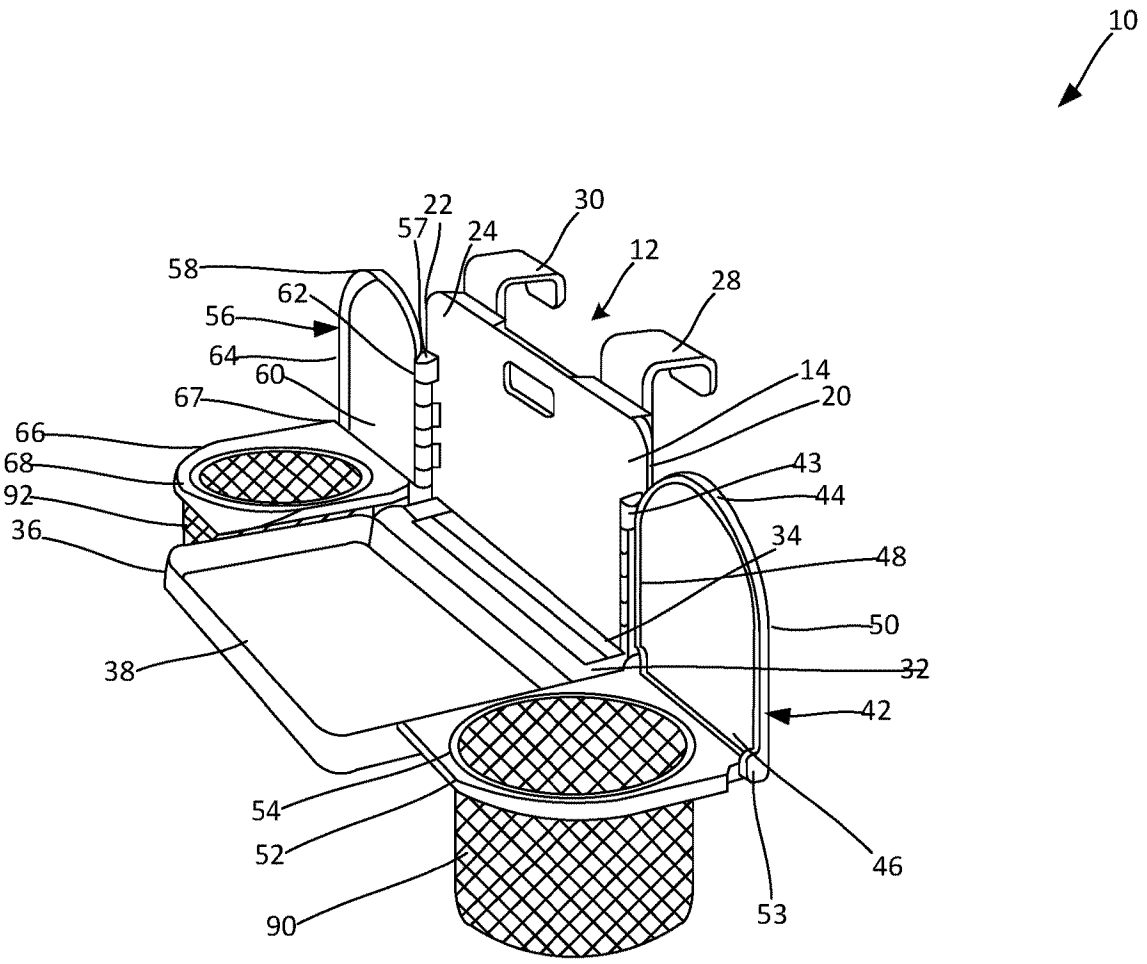
FIG. 2 is a perspective front view of an embodiment of the present invention in an open position.
Figure 3:
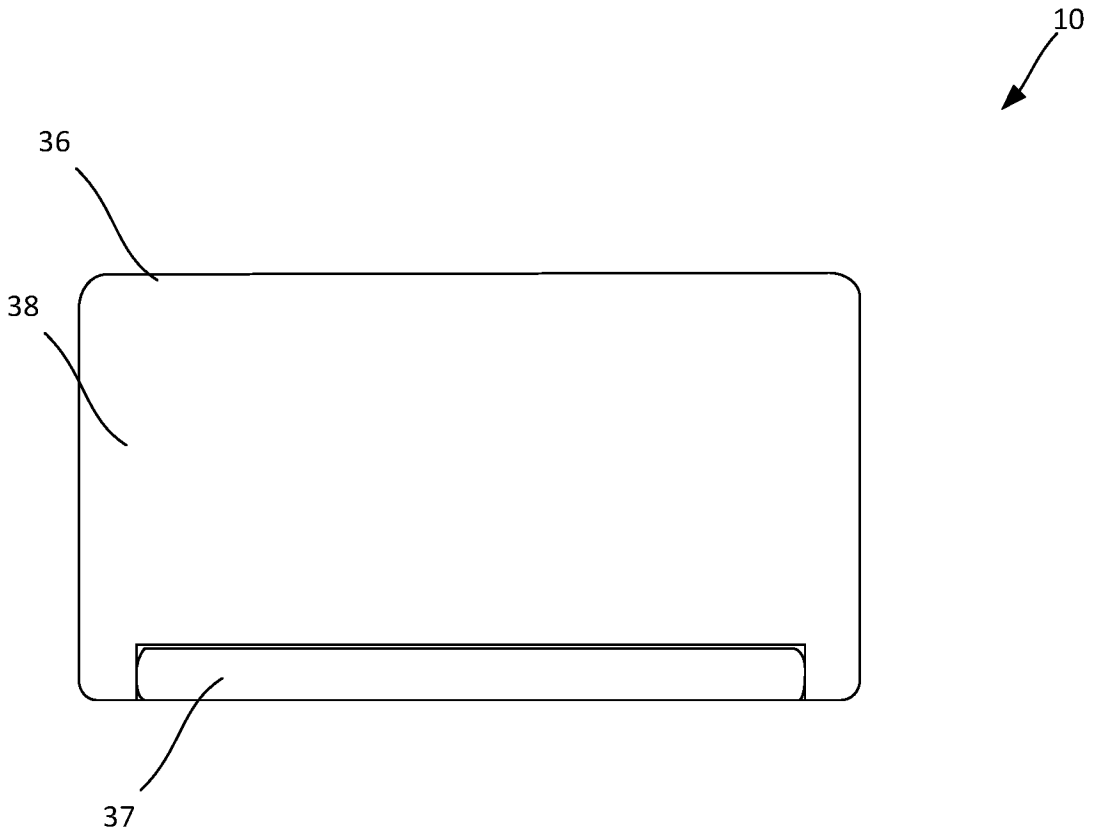
FIG. 3 is a front view of an embodiment of the present invention.
Figure 4:
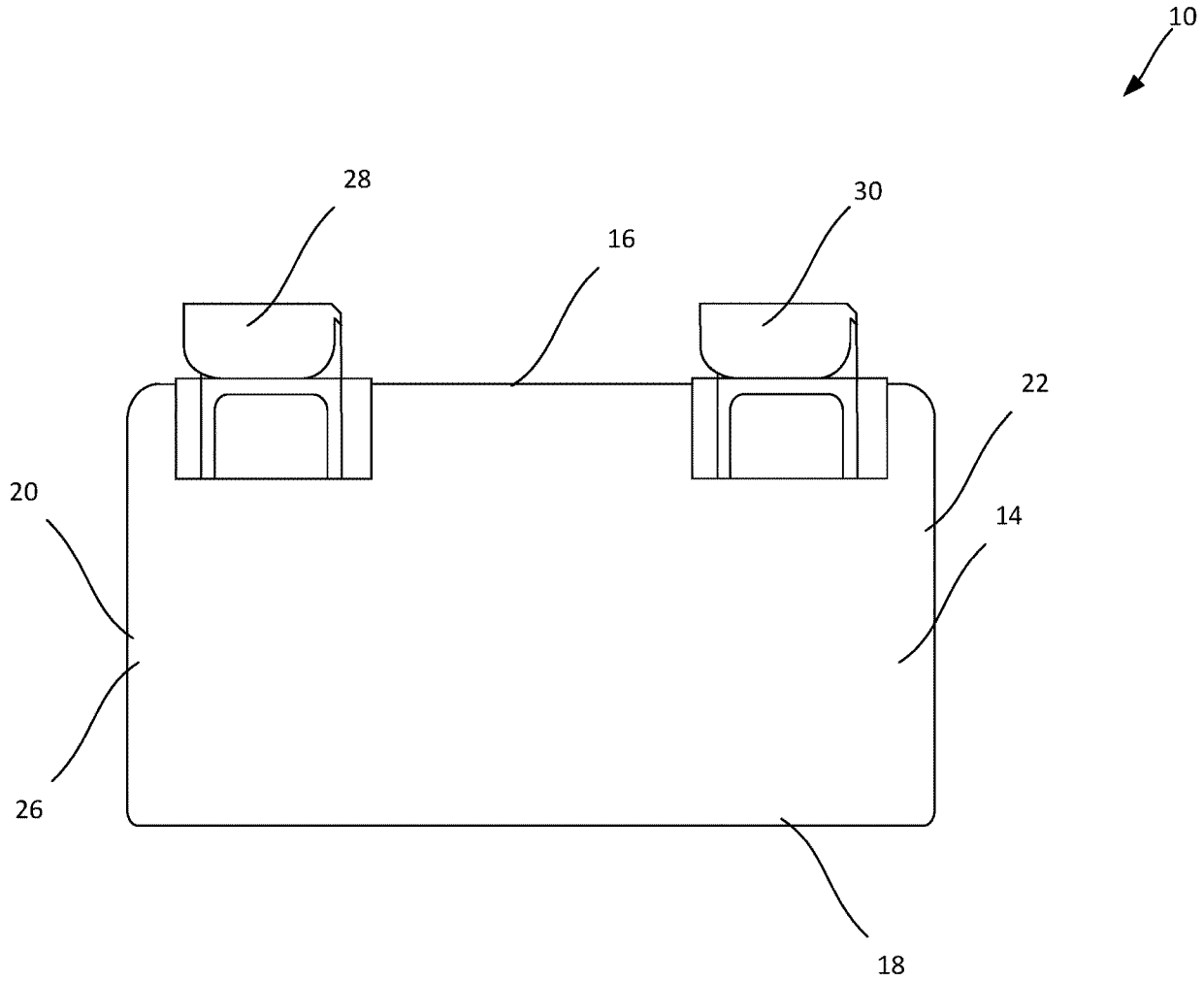
FIG. 4 is a back view of an embodiment of the present invention.

The present invention in generally directed to holders for cups, cans, bottles, food, hand-held cell phones or the like, and, more particularly, relates to foldable holders for supporting such items.

As illustrated in FIGS. 1-4, a collapsible multiple purpose apparatus 10 is disclosed. The apparatus includes a mounting framework 12 defined by rear wall 14 having a top edge 16, an opposing bottom edge 18, a first side edge 20 and an opposing second side edge 22. The first and second side edges 20, 22 extend between the top edge 16 and the bottom edge 18. The rear wall 14 having an inner surface 24 and an outer surface 26. These surfaces may have identifying logos or designs placed thereupon.

A first attachment member 28 is located proximate the top edge 16 and the first side edge 20 and extending from the outer surface 26. A second attachment member 30 located proximate the top edge 16 and the second side edge 22 and extending from the outer surface 26. The first and second attachment members 28, 30 are adapted to be secured over the back of a chair, such as a stadium, theatre and lawn chair. In some embodiments, the attachment members 28, 30 are securing hooks. The attachment members may be constructed of various sizes to be adapted to seats having various sizes.

A bottom support 32 extends from the inner surface 24 of the rear wall proximate the bottom edge 18. Bottom support 32 has a storage slot 34 for receiving an item therein, such as a cell phone, wallet, tablet, etc.

A tray 36 is pivotably securable to the bottom support 32 by a tray pivot component 37 for pivoting movement between a substantially perpendicular deployment relative to the inner surface 24 of the rear wall 14 and a stored deployment adjacent to the inner surface 24. The tray 36 has a first and second opposite surfaces 38, 40 with the first surface 38 for receiving an item thereon, and where an identifying logos or designs may be placed on second surface 40.

A first container stabilizer 42 is pivotally secured to the rear wall 14 as described below. The first container stabilizer 42 has a first container stabilizer top edge 44, an opposing first container stabilizer bottom edge 46, a first container stabilizer first side edge 48 and an opposing first container stabilizer second side edge 50. The first container stabilizer first and second side edges 48, 50 extending between the first container stabilizer top edge 44 and the first container stabilizer bottom edge 46.

The first container stabilizer first side edge 48 is pivotably securable by a first container stabilizer pivot component 43 to the first side edge 20 of the rear wall 14 for pivoting movement between a substantially side-by-side deployment relative to the first side edge 20 of the rear wall 14 and a stored deployment adjacent to the inner surface 24.

A first container shelf 52 is pivotably securable by a first container shelf pivot component 53 to the first container stabilizer bottom edge 46 for pivoting movement between a substantially perpendicular deployment relative to the first container stabilizer bottom edge 46 of the first container stabilizer 42 and a stored deployment adjacent to the first container stabilizer 42. The first container shelf 52 having a substantially circular first container receiving opening 54. Opening 54 is configured to receive and support a beverage cup, bottle or can.

A second container stabilizer 56 is pivotally secured to the rear wall 14 as described below. The second container stabilizer 56 has a second container stabilizer top edge 58, an opposing second container stabilizer bottom edge 60, a second container stabilizer first side edge 62 and an opposing second container stabilizer second side edge 64. The second container stabilizer first and second side edges 62, 64 extend between the second container stabilizer top edge 58 and the second container stabilizer bottom edge 60.

The second container stabilizer first side edge 62 is pivotably securable by a second container shelf pivot component 57 to the second side edge 22 of the rear wall 14 for pivoting movement between a substantially side-by-side deployment relative to the second side edge 22 of the rear wall 14 and a stored deployment adjacent to the inner surface 26.

A second container shelf 66 is pivotably securable by a second container shelf pivot component 67 to the second container stabilizer bottom edge 60 for pivoting movement between a substantially perpendicular deployment relative to the second container stabilizer bottom edge 60 of the second container stabilizer 56 and a stored deployment adjacent to the second container stabilizer 56. The second container shelf 66 having a substantially circular second container receiving opening 68. Opening 68 is configured to receive and support a beverage cup, bottle or can.

In some embodiments, a first mesh 90 webbing may be secured to the first container receiving opening 54 and a second mesh 92 webbing may be secured to the second container receiving opening 54. The mesh webbing may provide additional support for holding the beverage cup, bottle or can. The mesh webbing may be constructed from any flexible and/or collapsible material.

In operation, when in a closed position, apparatus 10 has a streamlined profile. The tray 36 is in a stored deployment adjacent to the inner surface 24. The first container stabilizer 42, the first container shelf 52, the second container stabilizer 56 and the second container shelf 66 are stored adjacent to, and between, the inner surface 24 and the tray 36.

To move apparatus 10 to an open position, tray 36 is moved into a perpendicular position relative to the inner surface 24 of the rear wall 14. The first and second container stabilizers 42, 56 are moved to a substantially side-by-side deployment relative to the first and second side edge 20, 22 of the rear wall 14. The first and second container shelves 52, 66 are moved to a substantially perpendicular deployment relative to the first and second container stabilizer bottom edges 46, 60.

Figure 5:
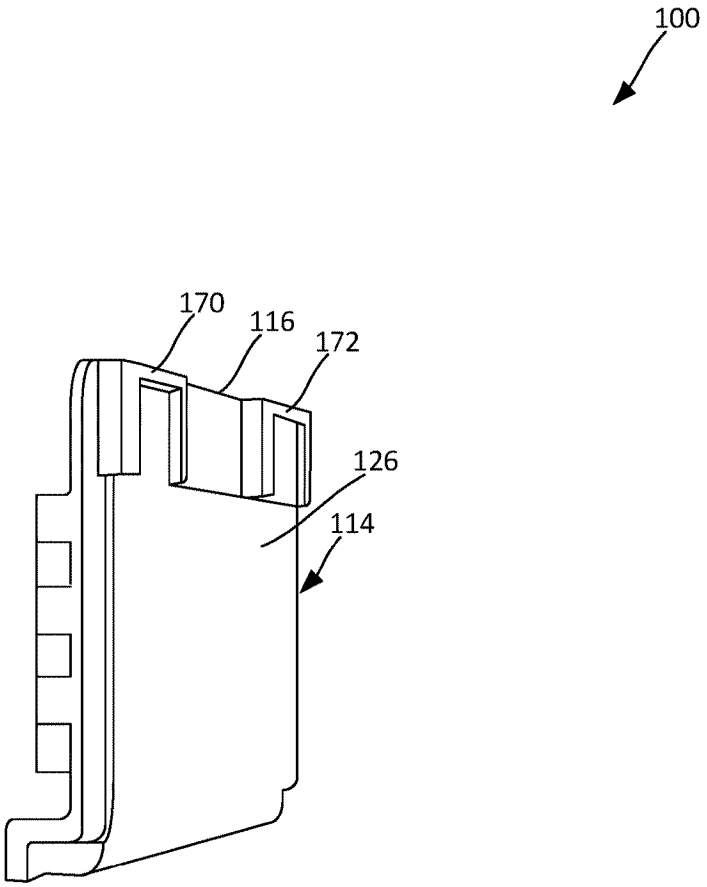
FIG. 5 is a perspective back view of an additional embodiment of the present invention in a closed position.
Figure 6:
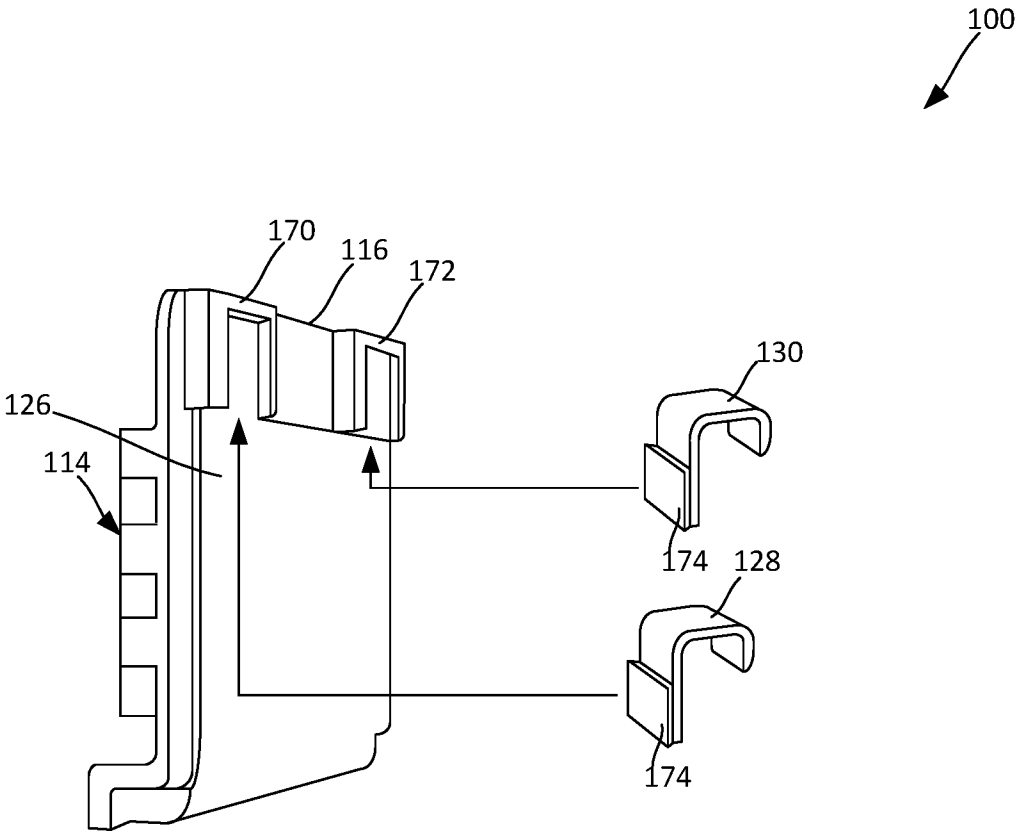
FIG. 6 is a perspective view of an embodiment of an attachment member of the present invention.

As illustrated in FIGS. 5 and 6, an additional embodiment of apparatus 100 is disclosed. In this embodiment, the attachment members 128, 130 are removably attached to the outer surface 126 of the rear wall 114.

Outer surface 126 has a first receiving notch 170 located proximate the top edge 116 and the first side edge 120. Outer surface also includes a second receiving notch 172 located proximate the top edge 116 and the second side edge 122. The first and second receiving notches 170, 172 configured to removably receive an attachment member 128, 130. Each of the two attachment members 128, 130 include a securing end 174, 176 are configured to engage the receiving notches 170, 172 to be removably secured thereto. The removably of the attachment members 128, 130 allow for a more compact profile of the apparatus 100 when in a closed position.

Figure 8:
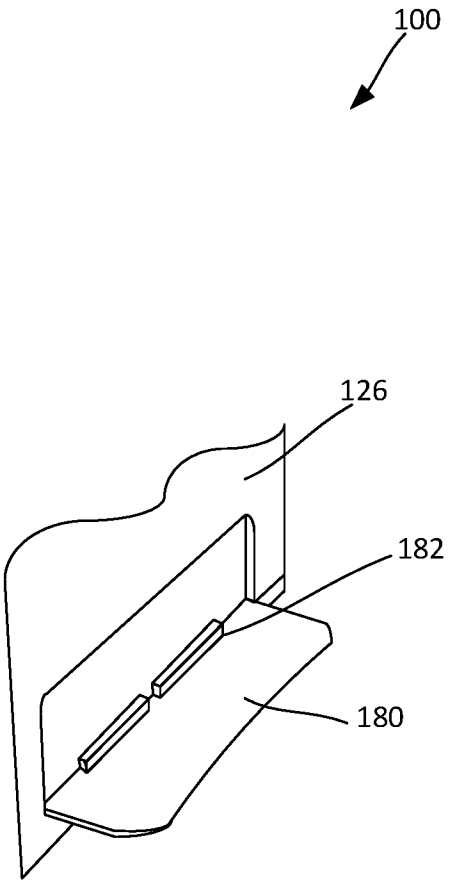
FIG. 8 is a perspective view of an embodiment of a support stand of the present invention in an open position.
Figure 7:
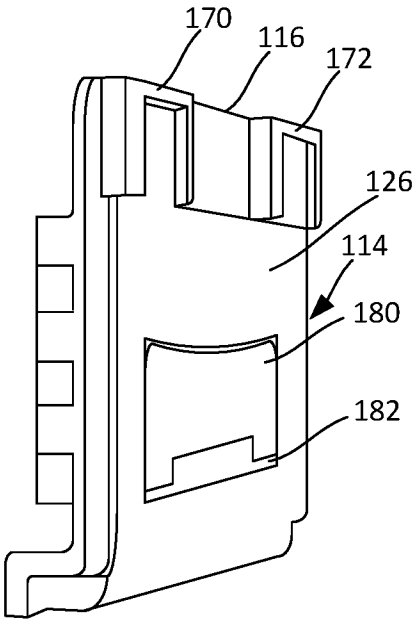
FIG. 7 is a perspective view of an embodiment of a support stand of the present invention in a closed position.

As illustrated in FIGS. 7 and 8, embodiments of apparatus 100 may also include a support stand 180 pivotably secured by a support stand pivot component 182 to the outer surface 126 of the rear wall 114 for pivoting movement between a substantially perpendicular deployment relative to the outer surface 126 of the rear wall 114 and a stored deployment adjacent to the outer surface 126. The support stand allows for the adjustment of the rear wall 114 away from the back of the seat upon which the apparatus 100 is secured thereto.

Figure 9:
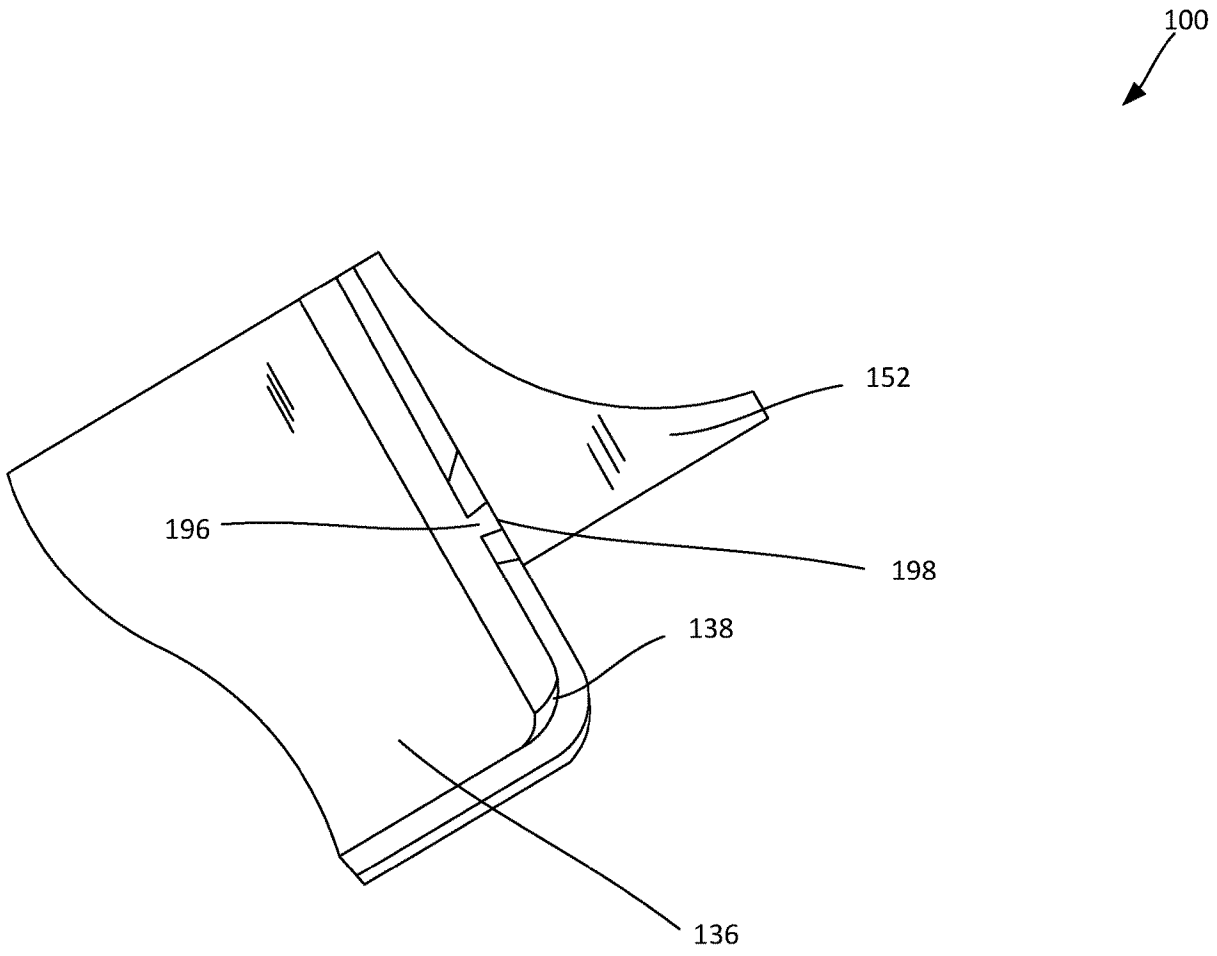
FIG. 9 is a perspective view of an embodiment of a container shelf of the present invention.

As illustrated in FIG. 9, embodiments of apparatus 100 may also include a stabilizing tab 196 located on the first surface 138 of tray 136. A receiving notch 198 is located on the first container shelf 152. In operation, the container shelf 152 is lowered into a perpendicular location proximate the tray 136. The stabilizing tab 196 of the tray 136 engages the receiving notch 198 to provide additional support to the container shelf 152. While not shown, a second stabilizing tab may also be located on the first surface 138 of tray 136 and configured to receive a second receiving notch located on the second container shelf.

The exact specifications and materials used in the manufacture of the apparatus of the present invention may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

We claim:

1. A collapsible multiple purpose apparatus comprising:

a mounting framework defined by rear wall having a top edge, an opposing bottom edge, a first side edge and an opposing second side edge, the first and second side edges extending between the top edge and the bottom edge, the rear wall having an inner surface and an outer surface;

a first attachment member located proximate the top edge and the first side edge and extending from the outer surface;

a second attachment member located proximate the top edge and the second side edge and extending from the outer surface, the first and second attachment members being adapted to be secured over the back of a chair;

a bottom support extending from the inner surface of the rear wall proximate the bottom edge, the bottom support having a storage slot for receiving an item therein;

a tray pivotably securable to the bottom support for pivoting movement between a substantially perpendicular deployment relative to the inner surface of the rear wall and a stored deployment adjacent to the inner surface, the tray having first and second opposite surfaces with the first surface for receiving an item thereon;

a first container stabilizer having a first container stabilizer top edge, an opposing first container stabilizer bottom edge, a first container stabilizer first side edge and an opposing first container stabilizer second side edge, the first container stabilizer first and second side edges extending between the first container stabilizer top edge and the first container stabilizer bottom edge, the first container stabilizer first side edge pivotably securable to the first side edge of the rear wall for pivoting movement between a substantially side-by-side deployment relative to the first side edge of the rear wall and a stored deployment adjacent to the inner surface;

a first container shelf pivotably securable to the first container stabilizer bottom edge for pivoting movement between a substantially perpendicular deployment relative to the first container stabilizer and a stored deployment adjacent to the first container stabilizer, the first container shelf having a substantially circular first container receiving opening;

a second container stabilizer having a second container stabilizer top edge, an opposing second container stabilizer bottom edge, a second container stabilizer first side edge and an opposing second container stabilizer second side edge, the second container stabilizer first and second side edges extending between the second container stabilizer top edge and the second container stabilizer bottom edge, the second container stabilizer first side edge pivotably securable to the second side edge of the rear wall for pivoting movement between a substantially side-by-side deployment relative to the second side edge of the rear wall and a stored deployment adjacent to the inner surface;

a second container shelf pivotably securable to the second container stabilizer bottom edge for pivoting movement between a substantially perpendicular deployment relative to the second container stabilizer and a stored deployment adjacent to the second container stabilizer, the second container shelf having a substantially circular second container receiving opening.

2. The collapsible multiple purpose apparatus of claim 1, wherein the attachment members are securing hooks.

3. The collapsible multiple purpose apparatus of claim 1, wherein the outer surface of the rear wall being further defined as having a first receiving notch located proximate the top edge and the first side edge and a second receiving notch located proximate the top edge and the second side edge, the first and second receiving notches configured to removably receive an attachment member; and each of the two attachment members further defined as having a securing end configured to engage the receiving notches to be removably secured thereto.

4. The collapsible multiple purpose apparatus of claim 1, further comprising:

a support stand pivotably secured to the outer surface of the rear wall for pivoting movement between a substantially perpendicular deployment relative to the outer surface of the rear wall and a stored deployment adjacent to the outer surface.

5. The collapsible multiple purpose apparatus of claim 1, further comprising:

a first mesh webbing secured to the first container receiving opening; and a second mesh webbing secured to the second container receiving opening.

* * * * *